United States Patent [19]

Hyler

[11] 3,962,804

[45] June 15, 1976

[54] SCRAPER HAVING FORWARDLY SWINGABLE APRON AND FULL WIDTH PIVOTED STRIKER

[75] Inventor: John H. Hyler, Peoria, Ill.

[73] Assignee: Westinghouse Air Brake Company, Pittsburgh, Pa.

[22] Filed: Mar. 3, 1975

[21] Appl. No.: 554,430

[52] U.S. Cl. ..... 37/126 AA; 37/126 AB; 37/129

[51] Int. Cl.[2] ..... C02F 3/62

[58] Field of Search ..... 37/126 AA, 126 AB, 129, 37/124

[56] References Cited

UNITED STATES PATENTS

| | | | |
|---|---|---|---|
| 2,291,950 | 8/1942 | Clark | 37/126 AA |
| 2,425,601 | 8/1947 | Daniels | 37/126 AA |
| 2,560,597 | 7/1951 | Reischl | 37/126 AB |
| 3,035,361 | 5/1960 | Peterson et al. | 37/129 |
| 3,331,149 | 7/1967 | Rapp | 37/8 |
| 3,660,914 | 5/1972 | Bechman et al. | 37/126 AC |

*Primary Examiner*—Stephen C. Pellegrino
*Attorney, Agent, or Firm*—Leydig, Voit, Osann, Mayer & Holt, Ltd.

[57] ABSTRACT

A scraper for earth moving purposes having an open fronted bowl including a pair of vertical side sheets and a back wall with a floor extending between the side sheets. The bowl is secured to the tractor by a pair of draft members which extend upwardly and forwardly for connection to the draft frame of the tractor. Bowl actuators coupled to the front end of the bowl support it at a selected predetermined level with respect to the draft frame. A pivoted strike off member is hinged in fixed position along the front edge of the floor and extending the full width of the bowl. An apron of arcuate shape and having vertical side plates is pendulously pivoted at the front of the bowl and provided with actuator means for swinging the apron between (a) an enclosing position, (b) a partially open soil retaining position, and (c) a fully open and upraised position creating a large discharge opening ahead of the floor. The strike off blade is moved from a horizontal position to its working position incident to movement of the apron from enclosing position to partially open position for full width scraping of the soil. The back wall of the bowl is forwardly movable by an actuator so that when the apron is moved to its fully open position the contained soil is forwardly ejected for discharge of the soil through the discharge opening.

3 Claims, 5 Drawing Figures

52
50
59
53
31
30
56
51
54
55
57
40
41
58
42
34
23
33
14
11
32
13
21
16
43
62
17
35
-DO-
61
24
25
28
L
26

SCRAPER HAVING FORWARDLY SWINGABLE APRON AND FULL WIDTH PIVOTED STRIKER

BACKGROUND OF THE INVENTION

The invention relates generally to an earth-moving device in the form of a tractor drawn scraper having a bowl carrying a pivoted blade with an associated forwardly swingable apron making the device capable of full width scraping, transport, and full width striking of the discharged soil.

In some conventional types of scrapers the same blade is utilized for both scraping and loading of the soil and striking of the discharged soil. In many of these prior designs the blade is not fixed with respect to the bowl but moves rearwardly on a sliding floor section along a non-horizontal path, making it difficult to obtain a predetermined depth of spread during the spreading of a given load. Also, where sliding floor sections are employed, the floor sections, the guides in which they are mounted, and the associated actuators are all subject to heavy abuse in the field, especially when pulled over large boulders or abrasive materials. In still other scraper structures utilizing the same blade for both scraping and striking, and in which the blade is fixedly mounted with respect to the bowl structure, the discharge opening ahead of the blade tends to be limited, making complete discharge of the contained soil difficult or impossible and sometimes requiring that scraping operations be discontinued until the earth loses some of its moisture, at considerable loss to the contractor.

SUMMARY OF THE INVENTION

It is, accordingly, an object of the present invention to provide a scraper having improved discharge and leveling characteristics and which avoids the operational and mechanical problems which have characterized conventional scrapers, particularly those employing a sliding floor section.

It is, more particularly, an object of the present invention to provide a scraper which uses the same full-width, pivoted blade for both scraping and for leveling, or strike-off, and which employs, ahead of the blade, an arcuate apron, the apron serving to retain the soil during the scraping phase and mounted for forward swing to create a large discharge opening ahead of the blade to facilitate ejection of the contained soil for spreading by the blade to predetermined thickness. It is a more specific object of the present invention to provide a pivoted scraper-striker blade having an associated swingable apron and in which the blade is automatically moved to a horizontal position when the apron is fully closed and moved to an angled working position when the apron is partially opened so that the scraped soil is retained both by the floor of the bowl and by the apron. Means are, in addition, provided for forced ejection of the load in the bowl as the apron swings forwardly and upwardly, which not only creates a large discharge opening but which insures complete dumping of all the soil retained on the apron.

It is a general object of the present invention to provide a scraper having a pivoted and automatically actuated blade which is employed for both scraping and strike-off, which is capable of achieving a full load in a wide range of soil conditions without necessity for employing an associated elevator, and which is capable of discharging and spreading soil reliably and to even depth over the entire width of the bowl. A wide range of scraping depth and wide range of striking level are available utilizing only the bowl cylinders and without necessity for separate adjustment of the position or angle of the blade.

DETAILED DESCRIPTION OF THE PREFERRED EMBODIMENT

Figure 1:
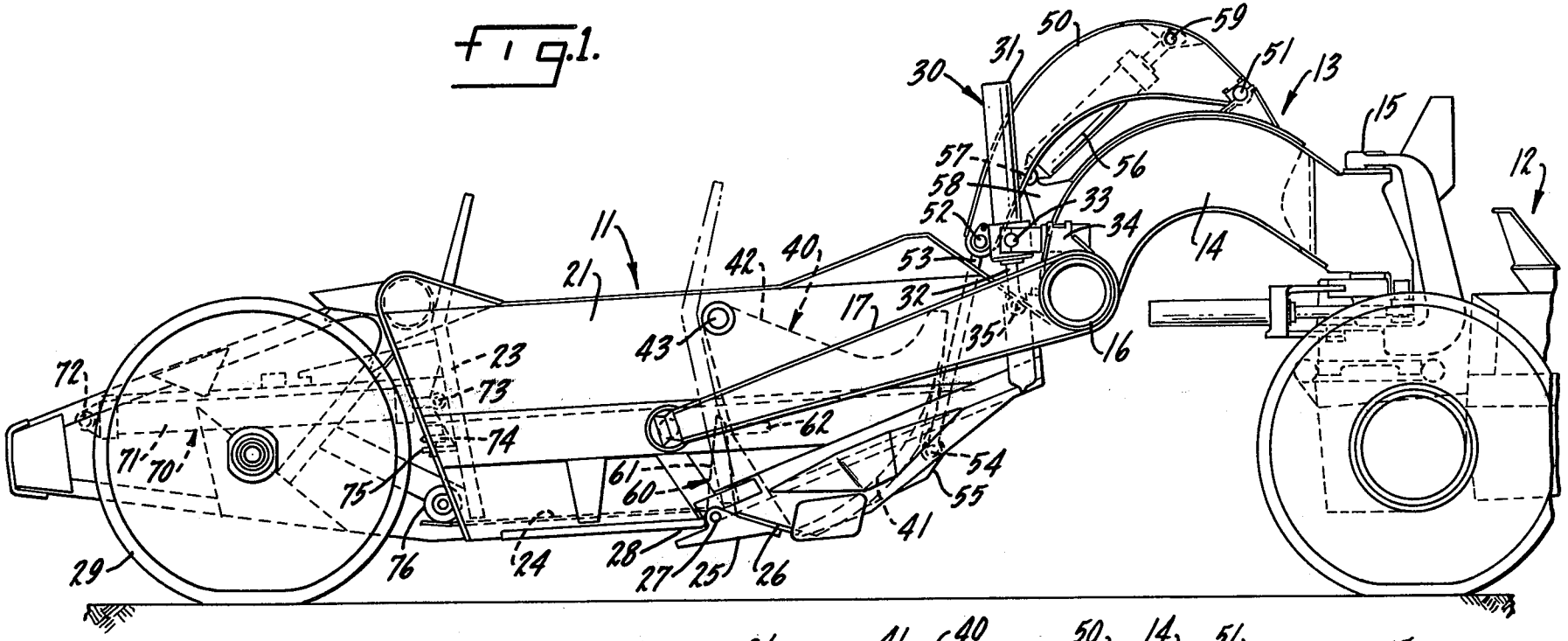
FIG. 1 is a general side elevation of a tractordrawn scraper constructed in accordance with the present invention.
Figure 2:
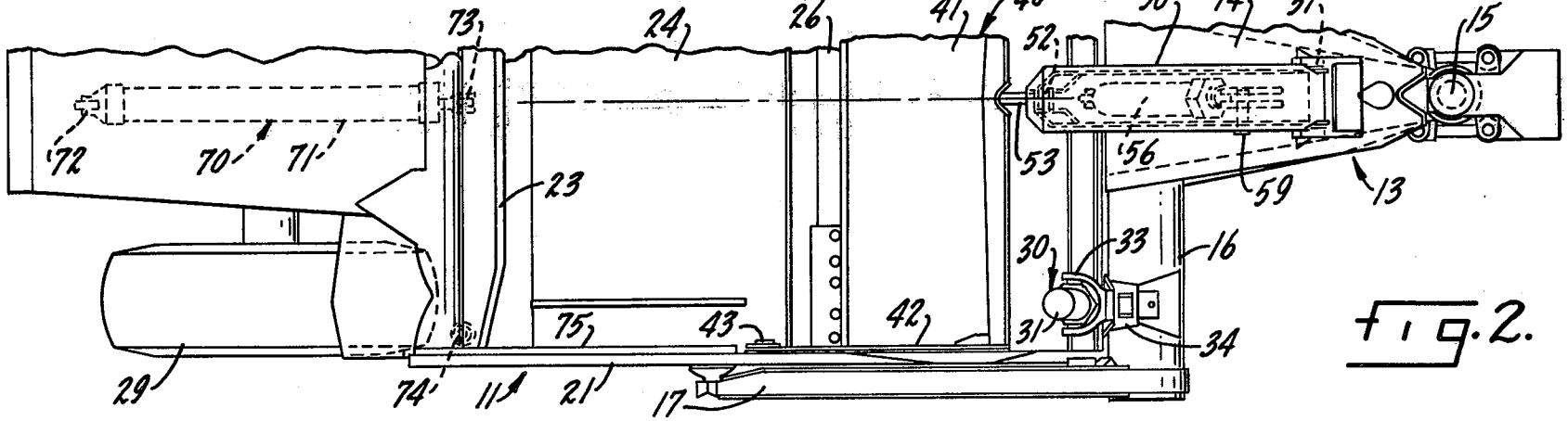
FIG. 2 is a partial plan view of the scraper assembly.

Referring now to the drawings there is disclosed a scraper assembly having a bowl 11 and a tractor 12 interconnected by a draft frame 13. The draft frame includes a so-called gooseneck 14 which is of rigid construction pivoted to the tractor at 15 for horizontal swinging movement and carrying a torque tube, or yoke tube, 16, to the lateral ends of which are rigidly secured draft members 17, one on each side of the bowl (only one shown). Bowl 11 has side sheets 21, a back wall 23 and a floor 24. Mounted along the front edge of the floor is a combined scraper - strike-off member 25 having blade 26 which extends the width of the bowl and which is pivoted to the bowl along a horizontally extending hinge 27. The working position of the blade is determined by a stop 28. The rear end of the bowl structure is supported upon a pair of rubber tired wheels 29.

For the purpose of determining the running height of the bowl, and hence the working height of the blade under working conditions, a pair of bowl actuators 30 are provided, one at each of the front corners of the bowl (only one being shown in the drawings) including a cylinder 31 having a piston rod 32. The cylinder is secured at its lower end 33 upon a bracket 34 mounted upon the torque tube 16. The piston rod is secured to the bowl structure by a pin 35. When the actuator 30 is fully contracted, as shown in FIG. 1, the bowl rides high for transport purposes, clear of any ground obstruction. In operation the piston rod 32 is extended to drop the front of the bowl, and with it the blade, into working position.

In accordance with the present invention there is provided, forwardly of the floor 24, an apron which extends transversely between the side sheets in the front portion of the bowl, the apron having vertical side plates lying adjacent the side sheets and pendulously pivoted to the sheets for forward swinging movement between a horizontal enclosing position and an upraised open position in which a large discharge opening is created ahead of the floor, with the back wall of the bowl being movable for ejection of the contained soil through the discharge opening. Further in accordance with the invention means are interposed between the apron structure and the combined scraping and striking blade causing the blade to be in a horizontal position when the apron is closed and for causing the blade to be dropped to its angled working position when the apron is in a partially open, soil retaining position.

Turning to the drawings, the apron, indicated at 40, has, in the disclosed embodiment, an arcuate, or concave, floor 41 which extends the width of the bowl and to which is secured, at the respective ends, a pair of side plates 42 which lie closely adjacent the side sheets 21 and which are pendulously pivoted to such side sheets at pivots 43. The apron pivots are aligned along a transversely extending axis which, in the preferred embodiment, lies directly above and parallel to the hinge 27 which mounts the scraping and striking blade.

Figure 3:
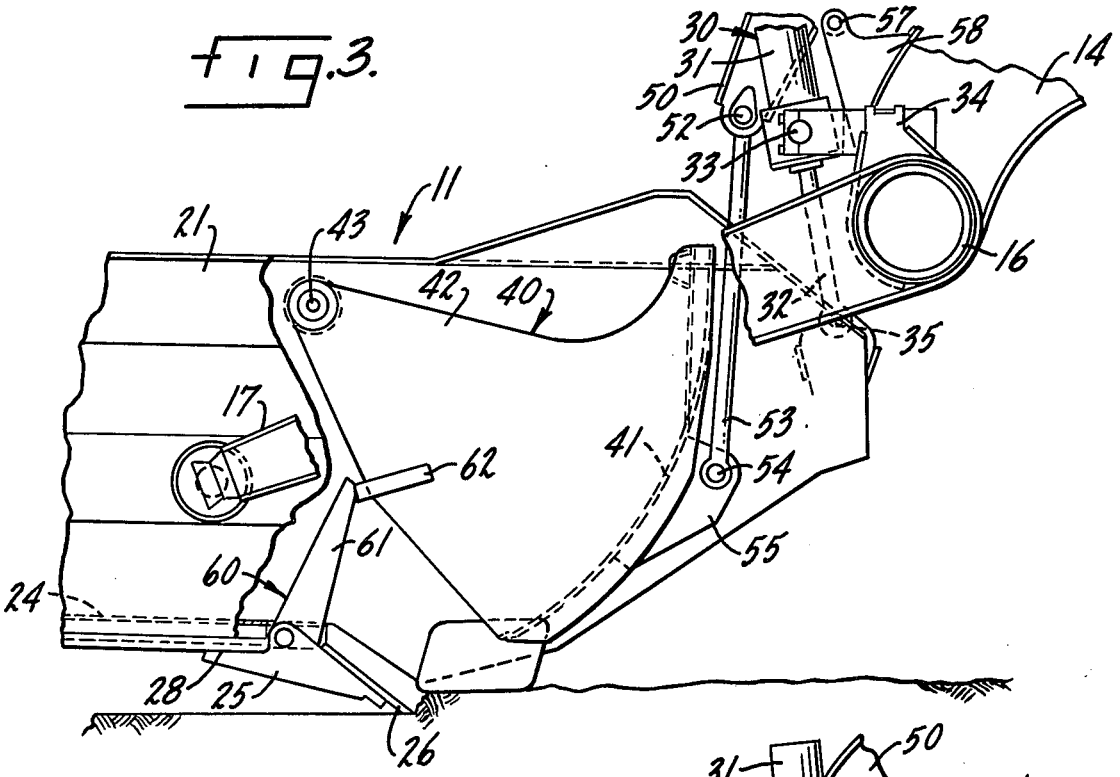
FIG. 3 is a simplified elevational view of the bowl assembly in the "fill" mode and with the apron partially open.
Figure 5:
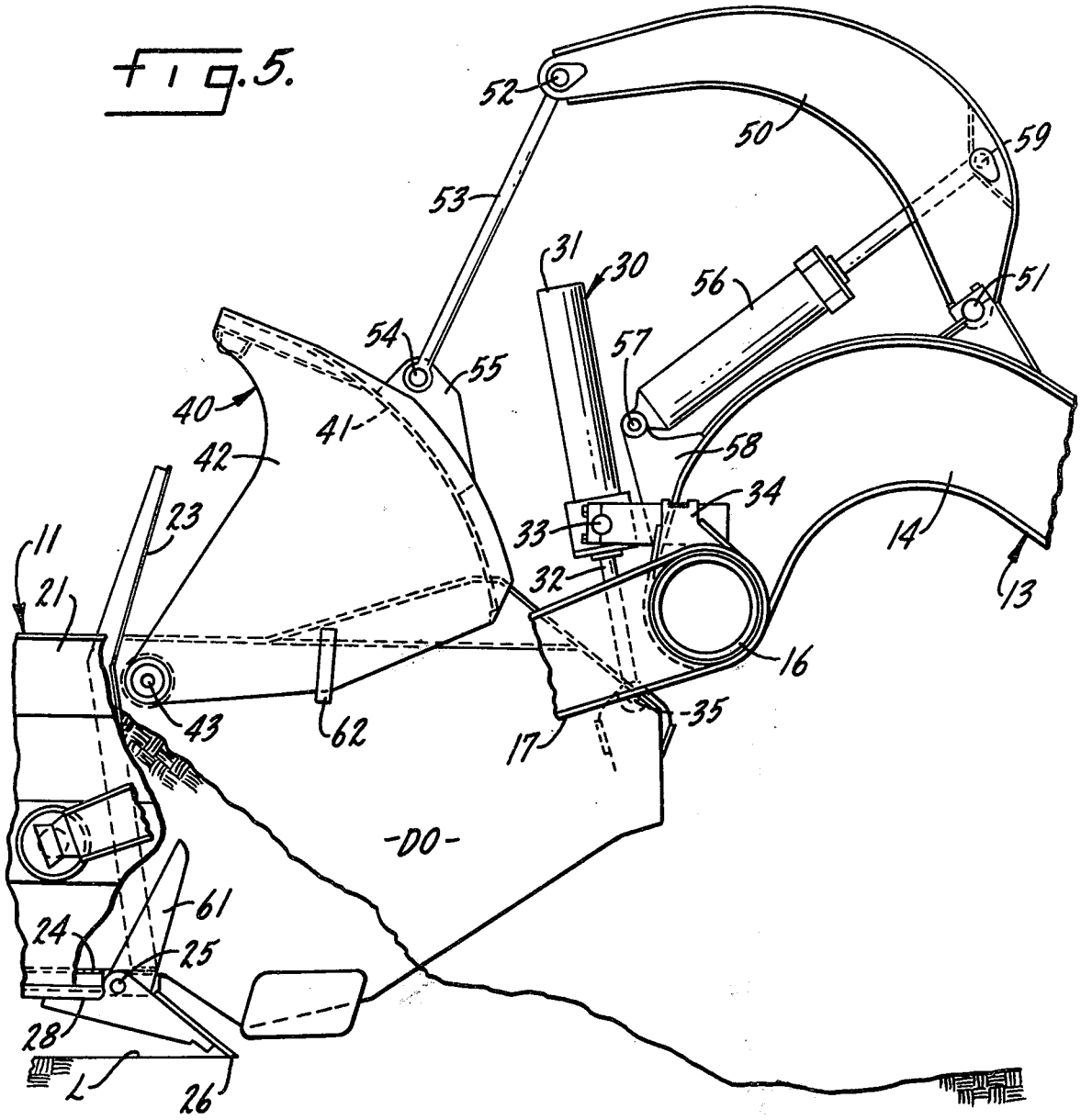
FIG. 5 is a view similar to FIGS. 3 and 4 showing the device in the "discharge and striking" mode, with the apron swung forwardly to an upraised position.

For the purpose of moving the apron between its enclosing position illustrated in FIG. 1, the partially open position illustrated in FIG. 3 and the fully open, upraised, position shown in FIG. 5, the apron has an actuating arm 50 which is pivoted to the gooseneck at 51 and which has a connection 52 at its opposite end, the connection 52 being connected to the upper end of an actuating rod, or drop link, 53. The lower end of the link, indicated at 54, is pinned to a bracket 55 which is secured to the underside of the apron. For positioning the arm 50, an apron actuator 56 is provided having its cylinder anchored by a pin 57 to a bracket 58 which is mounted on the gooseneck 14. The piston rod of the actuator is coupled, by a pin 59, to the central portion of the arm 50 so that the arm, in effect, constitutes a lever of the third class.

For insuring that the blade is in its horizontal transport position when the apron is in the enclosing position illustrated in FIG. 1, the blade has an actuating mechanism 60 which includes an arm 61 which is rigid with the strike-off member 25 and which lies in the path of movement of an actuating member or abutment 62 secured to side plate 42 of the apron structure, the elements 61, 62 preferably being repeated on the opposite side of the bowl (not shown) for application of balanced forces. The member 62 may be though of as an actuating cam and the arm 61 as the cam follower. Consequently, considered from the point of view of function, the terms arm and abutment are general terms referring to a radius member and a member acting thereon so that the specific shapes of the members 61, 62 shall be considered as exemplary only. In any event, it will be apparent that when the apron is swung clockwise by the actuator 56, member 62 cams the arm 61 into upright position thereby rotating the blade from its working position to horizontal transport position.

Means are provided for thrusting the rear wall 23 of the bowl forwardly, incident to full upward swinging of the apron 40, for the purpose of forcing the contained soil through the discharge opening forwardly of the blade and which is vacated by the apron. This is accomplished by an actuator assembly 70 having a cylinder 71 which is pinned, at its rear end 72, to the supporting structure and which has its piston rod connected, at 73, to the rear wall. The rear wall is guided, for forward movement, by lateral rollers 74, one on each side, which engage respective tracks 75 on the side sheets, with the lower end of the wall being additionally guided by rollers 76 which ride along the floor 24. The floor 24 is quite short in longitudinal dimension, on the same order as, and preferably slightly shorter than, the fore-and-aft span of the apron so that the soil, upon being pressed forwardly by the rear wall, moves freely through the discharge opening of the bowl rather than blocking itself by expanding outwardly against the side sheets which may occur with a longer floor dimension.

Figure 4:
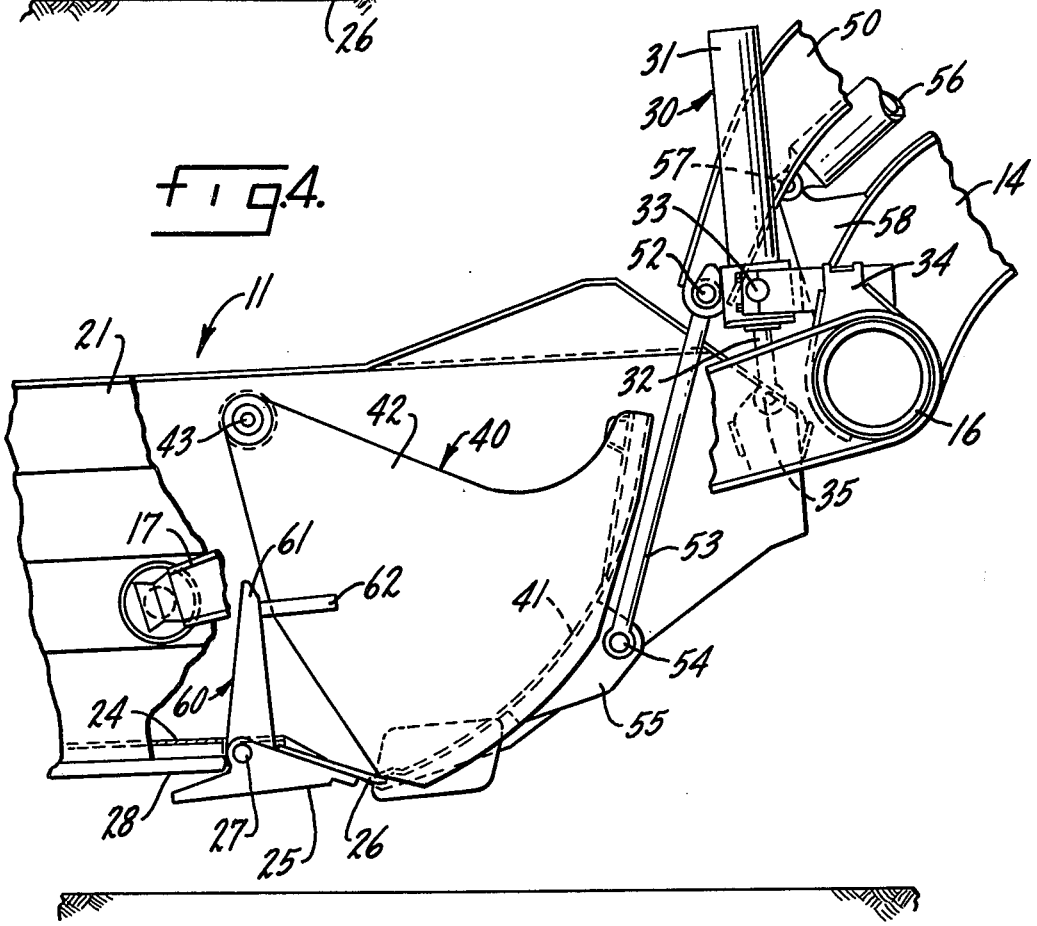
FIG. 4 is a view similar to FIG. 3 but with the structure in the "transport" mode and with the apron closed.

The other operating features and advantages of the device will become apparent upon inspection of FIG. 3 which shows the scrap-load condition, FIG. 4 which shows the transport condition, and FIG. 5 which shows the unload - strike position.

For the scrape - load condition shown in FIG. 3, the bowl actuators 30 are substantially fully extended and the apron actuator 56 is partially extended, causing the apron to move to the partially open condition, accompanied by dropping of the blade 26 to working position determined by stop 28 and in which the blade is extended below the undisturbed ground level. While the apron is partially open in the loading mode it is nonetheless in a soil-retaining position. Thus, as the scraper is drawn forwardly by the tractor, the soil is loosened and scraped by the blade upwardly and into the bowl, gradually filling the bowl and spilling over into the apron, the pressure exerted by the incoming soil being sufficiently great so that the soil mounds up in the bowl without requiring the assistance of a power driven elevator. The rate that the bowl is filled is, of course, dependent upon the running depth of the blade.

When sufficient soil has collected in the bowl and apron, the apron actuator 56 is forcibly contracted causing the apron to swing downwardly, that is clockwise, until it occupies the enclosing transport position shown in FIG. 4. During the course of the closing movement the stop member, or cam 62, on the apron strikes the arm 61, causing the blade to swing from its scraping position to its substantially horizontal transport position where the front edge of the blade nests against the rear edge of the apron. The bowl actuators 30 are, at the same time, fully contracted, so that the front end of the bowl is raised well clear of the ground so as to avoid boulders or other obstructions as the bowl is drawn to the area where the load is to be discharged.

When such area is reached, the bowl is lower into the position illustrated in FIG. 5 and the apron actuator 56 is substantially fully extended, causing the apron to swing forwardly. The initial forward movement of the apron causes the stop member, or cam 62 to retreat with respect to the arm 61 so that the blade 26 is again dropped to its angled working position, determined by stop 28. This establishes a strike off level L which can be adjusted with precision by adjusting the bowl actuators 30. Continued expansion of the apron actuator 56 opens a wide discharge opening DO ahead of the floor 24 and more specifically ahead of the blade. At the same time, the rear wall actuator 70 is extended, thrusting the rear wall 23 forwardly so that the soil which has collected in the bowl is gradually ejected through the discharge opening, with immediate striking to desired level by the blade. It will be apparent that when the apron is swung from the retaining position illustrated in FIGS. 3 and 4 to the unloading position illustrated in FIG. 5, the arcuate floor of the apron is swung to an upraised, and even partially inverted, position above the level of the side sheets so that the front of the bowl is "wide open" and to insure the complete dumping of the soil on the apron.

It is one of the features of the present construction that the discharged soil which is struck off at a constant level the full width of the bowl may be deposited at any desired thickness, down to an extremely thin layer. Where it is desired to deposit the soil in a thick layer the apron may be swung all the way without delay. However, when deposition soil in a thin layer the apron is not immediately swung to the fully upraised position illustrated in FIG. 5 but it is swung upward only gradually as the rear wall is thrust forward so as to control the rate of discharge and to prevent creation of longitudinal ridges at the ends of the blade. Because of full width striking at a level which remains constant during discharge of the entire load, the present scraper may be used for highly precise work such as the final leveling and contouring of a landscaped area such as a golf course or the like.

It is a further feature of the construction that it is capable of handling soil of a wide range of consistency, all the way from dry, friable soil to thick clayey soil which ordinary scrapers find it difficult to handle. The present construction is distinguished by a floor 24 which is relatively short in its longitudinal dimension so that the soil which is thrust forwardly by the back wall tends to move out over the blade rather than becoming wedged with buildup of lateral force against the side sheets. The soil may leave the bowl forwardly free of obstruction, which is to be constrasted with conventional scrapers in which an opening is provided only at the bottom of the bowl and which require the soil to drop straight down, a mode of discharge which is frequently defeated by the bridging or arching of clayey soils at the front end of the bowl and above the discharge opening.

The terms "arcuate" and "concave" as applied to the floor of the apron 40 will be understood to imply capability of soil retention and swingability and apply to faceted floors as well as floors of smooth curvature.

I claim as my invention:

1. In a scraper for earth moving purposes, the combination comprising an open-fronted bowl including a pair of spaced vertical side sheets and a back wall as well as a floor extending between the side sheets in the rear of the bowl, ground wheels for supporting the bowl and mounted behind the rear of the bowl, ground wheels for supporting the bowl and mounted behind the back wall, a tractor-supported draft frame, a pair of draft members pivotally secured at their rear ends to the side sheets and extending forwardly and upwardly with rigid connection at their forward ends to the draft frame, actuator means coupled to the front end of the bowl for selectively supporting it at a predetermined level with respect to the draft frame, an apron having a bottom extending traversely between the side sheets in the front portion of the bowl, the apron having vertical side plates lying adjacent the side sheets and pendulously pivoted thereto, a pivoted strike-off member hinged in fixed position along the front edge of the floor and having a blade extending substantially the full width of the bowl, the strike-off member having a horizontal transport position in which it serves to enclose the bottom of the bowl and a downwardly projecting working position, actuator means for moving the apron selectively between (a) a closed position, (b) a partially open soil retaining position, and (c) a fully open position creating a large dicharge opening ahead of the floor, means including an abutment at the rear portion of the apron and an arm on the pivoted strike-off member, the arm being in the path of rearward movement of the abutment so that as the apron is swung rearwardly into closed position the blade is swung upwardly into its horizontal transport position and so that when the apron is swung from its closed position to its partially open position the blade is moved to its working position for use of the blade as a full width scraper, with the scraped soil being contained by the bowl and apron, the back wall of the bowl being movable and having an actuator for forward ejection of the contained soil incident to movement of the apron to its fully open position for use of the blade as a full width striker.

2. The combination as claimed in claim 1 in which the apron actuator means includes an arm pivoted to the draft frame at its front end and having a drop link at its rear end connected to the front edge portion of the apron, and an hydraulic cylinder interposed between the arm and the draft frame for swinging the arm and the connected apron upwardly and downwardly.

3. In a scraper for earth moving purposes, the combination comprising an open-fronted bowl including a pair of spaced vertical side sheets and a back wall as well as a floor extending between the side sheets in the rear of the bowl, ground wheels for supporting the bowl and mounted behind the back wall, a tractorsupported draft frame, a pair of draft members pivotally secured at their rear ends to the side sheets and extending forwardly and upwardly with rigid connection at their forward ends to the draft frame, actuator means coupled to the front end of the bowl for selectively supporting it at a predetermined level with respect to the draft frame, an apron extending transversely between the side sheets in the front portion of the bowl, a pivoted strike-off member hinged in fixed position for movement about a transverse axis along the front edge of the floor and having a striker blade extending substantially the full width of the bowl, the strike-off member having a horizontal transport position and a downwardly projecting working position, the floor, strike-off member and apron serving together to enclose the bottom of the bowl, the apron having vertical side plates lying adjacent the side sheets and pendulously pivoted thereto above the transverse axis for forward swinging movement of the apron from its enclosing position to an open position to create a discharge opening ahead of the floor, the back wall of the bowl being movable and having an actuator for ejecting the collected material, and actuator means for moving the apron between its open and closed positions, a cam and cam follower interposed between the apron and strike-off member for permitting the strike-off member to drop when the apron is moved forwardly a short distance and for raising the strike-off member to its horizontal transport position as the apron completes its rearward swing to closed position, the cam being connected to the rear portion of the apron and the cam follower being in the form of an arm on the the strike-off member eccentrically related to the hinge axis.

* * * * *